United States Patent [19]

Komuro

[11] Patent Number: 4,469,926

[45] Date of Patent: Sep. 4, 1984

[54] SWITCHING SYSTEM IN A COMBINED MICROWAVE AND CONVECTION COOKING APPARATUS

[75] Inventor: Yoneo Komuro, Nara, Japan

[73] Assignee: Sharp Kabushiki Kaisha, Osaka, Japan

[21] Appl. No.: 346,533

[22] Filed: Feb. 8, 1982

[30] Foreign Application Priority Data

Feb. 16, 1981 [JP] Japan ..... 56-21000

[51] Int. Cl.[3] ..... H05B 6/68

[52] U.S. Cl. ..... 219/10.55 B; 219/10.55 R; 219/400

[58] Field of Search ..... 219/10.55 B, 10.55 R, 219/10.55 C, 400, 492; 307/38, 39, 40, 41

[56] References Cited

U.S. PATENT DOCUMENTS

| | | | |
|---|---|---|---|
| 4,196,330 | 4/1980 | Payne | 219/10.55 B |
| 4,332,992 | 6/1982 | Larsen et al. | 219/10.55 R |
| 4,366,357 | 12/1982 | Satoh | 219/10.55 B |

FOREIGN PATENT DOCUMENTS

| | | | |
|---|---|---|---|
| 54-65850 | 5/1979 | Japan | 219/10.55 B |
| 54-115449 | 9/1979 | Japan | 219/10.55 B |
| 54-128037 | 10/1979 | Japan | 219/10.55 B |

*Primary Examiner*—Roy N. Envall, Jr.
*Assistant Examiner*—Philip H. Leung
*Attorney, Agent, or Firm*—Birch, Stewart, Kolasch & Birch

[57] ABSTRACT

A combined microwave and convection cooking apparatus includes a microwave generation circuit for microwave cooking purposes, and an electric heater for convection cooking purposes. A variable cooking motor and a selection switch is provided for controlling the mean output level of the microwave generation circuit in the microwave cooking mode. In a mixed cooking mode, the selection switch is connected to the microwave generation circuit and the electric heater. The variable cooking motor switches the selection switch so that the microwave generation circuit and the electric heater are alternately energized in the mixed cooking mode.

3 Claims, 2 Drawing Figures

SWITCHING SYSTEM IN A COMBINED MICROWAVE AND CONVECTION COOKING APPARATUS

BACKGROUND AND SUMMARY OF THE INVENTION

The present invention relates to a combination cooking apparatus which selectively performs a microwave cooking operation and a convection heating cooking operation.

A preferred cooking operation is performed in the combination cooking apparatus when the microwave cooking operation and the convection heating cooking operation are alternately conducted. Such a cooking operation is referred to as a "mixed cooking" operation. To conduct the mixed cooking, a switching system is inevitably required to alternately energize a magnetron and an electric heater.

Accordingly, an object of the present invention is to provide a switching system in a combined microwave and convection cooking apparatus for conducting a mixed cooking operation.

Another object of the present invention is to simplify a circuit construction of a control system in a combined microwave and convection cooking apparatus.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

A typical construction of a combined microwave and convection cooking apparatus is described in copending application Ser. No. 255,093, "COOKING APPARATUS OF THE HEATED AIR CIRCULATING TYPE" filed on Apr. 17, 1981 by Kazuyuki Matsubayashi and Koichi Tateda and assigned to the same assignee as the present application and now abandoned.

A variable cooking switching system is developed in a microwave oven for varying an output level of the magnetron, thereby controlling the cooking intensity. The main feature of the present invention is to utilize the variable cooking switching system for alternately activating the magnetron and the electric heater in the mixed cooking mode.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
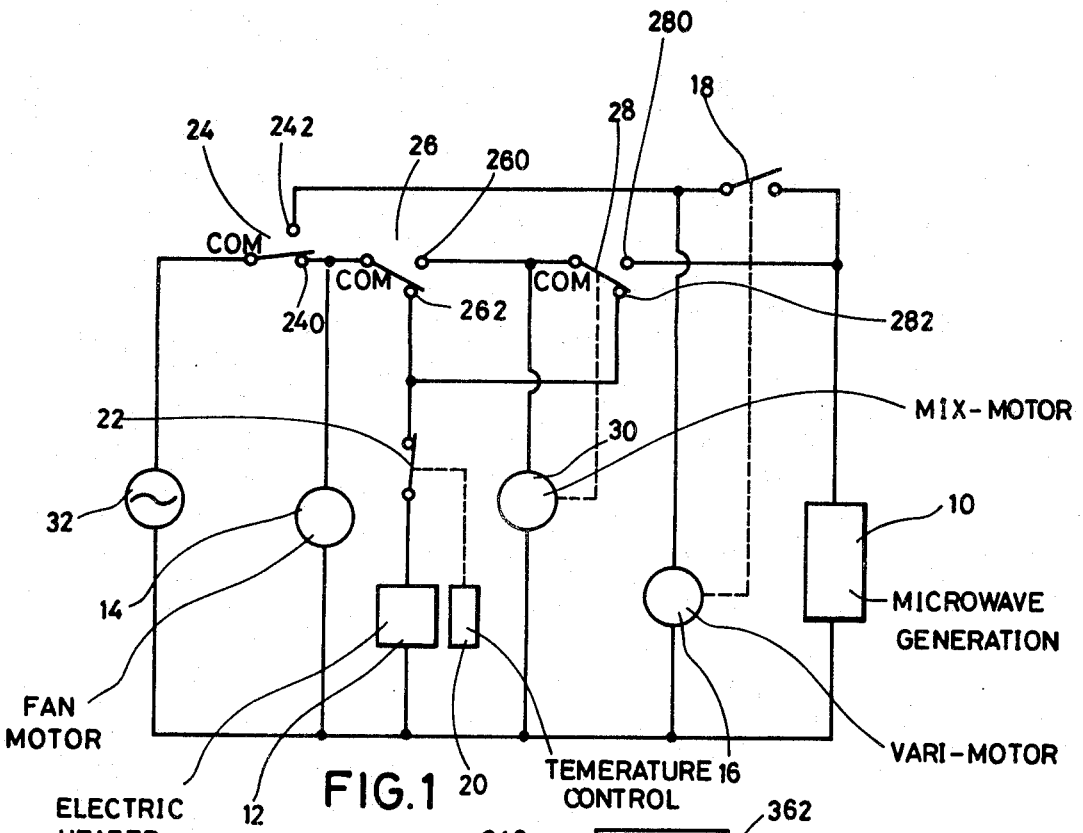
FIG. 1 is a circuit diagram of a combined microwave and convection cooking apparatus of a prototype of the present invention.

FIG. 1 shows a combined microwave and convection cooking apparatus of the prototype of the present invention.

The combined microwave and convection cooking apparatus generally comprises a microwave generation circuit 10 for supplying the microwave energy to an oven cavity, an electric heater 12 and a fan motor 14 for conducting the convection heating cooking. A variable cooking motor 16 functions to close a switch 18 in a desired interval, thereby controlling the output level of the microwave generation circuit 10. A temperature control unit 20 detects a temperature in the oven cavity to develop a control signal for switching a switch 22, thereby controlling a temperature in the convection cooking operation.

To perform the mixed cooking, wherein the microwave generation circuit 10 and the electric heater 12 are alternately activated, three selection switches 24, 26 and 28, and a mixed cooking motor 30 are provided in the prototype of the present invention as shown in FIG. 1. The switch 24 is a microwave selection switch, the switch 26 is a convection selection switch and the switch 28 is a heat control selection switch.

To conduct the mixed cooking, the common terminal of the selection switch 24 is connected to a first contact 240, and the common terminal of the selection switch 26 is connected to a first contact 260. The mixed cooking motor 30 is supplied with power from a power source 32. In response to the rotation of the mixed cooking motor 30, the common terminal of the selection switch 28 is alternately connected to a first contact 280 and a second contact 282 with a predetermined interval. When the common terminal of the selection switch 28 is connected to the first contact 280, the microwave generation circuit 10 is supplied with power from the power source 32. When the common terminal of the selection switch 28 is connected to the second contact 282, the electric heater 12 is supplied with the power from the power source 32 via the switch 22. In the mixed cooking operation mode, the fan motor 14 is continuously activated to circulate the heated air.

To conduct the convection cooking, the common terminal of the selection switch 24 is connected to the first contact 240, and the common terminal of the selection switch 26 is connected to a second contact 262. Thus, the fan motor 14 is activated, and the electric heater 12 is energized via the switch 22 associated with the temperature control unit 20.

To conduct the microwave cooking, the common terminal of the selection switch 24 is connected to a second contact 242. The variable cooking motor 16 is supplied with power from the power source 32. In response to the rotation of the variable cooking motor 16, the switch 18 is closed or opened in a predetermined interval. When the switch 18 is closed, the microwave generation circuit 10 is supplied with power from the power source 32. In order to prevent an erroneous operation, the selection switch 28 is constructed so that the common terminal thereof is normally connected to the second contact 282.

The variable cooking motor 16 and the switch 18 function to control a mean output level of the microwave generation circuit 10. A typical construction associated with the variable cooking motor 16 and the switch 18 is disclosed in U.S. Pat. No. 4,133,998, "COOKING MODE SELECTOR FOR CONTINUOUSLY VARYING A MEAN OUTPUT LEVEL OF A MAGNETRON IN A MICROWAVE OVEN" issued on Jan. 9, 1979.

The above-mentioned prototype of the present invention requires the switching system including the mixed cooking motor 30 and the selection switch 28 in addition to the switching system including the variable cooking motor 16 and the switch 18.

Figure 2:
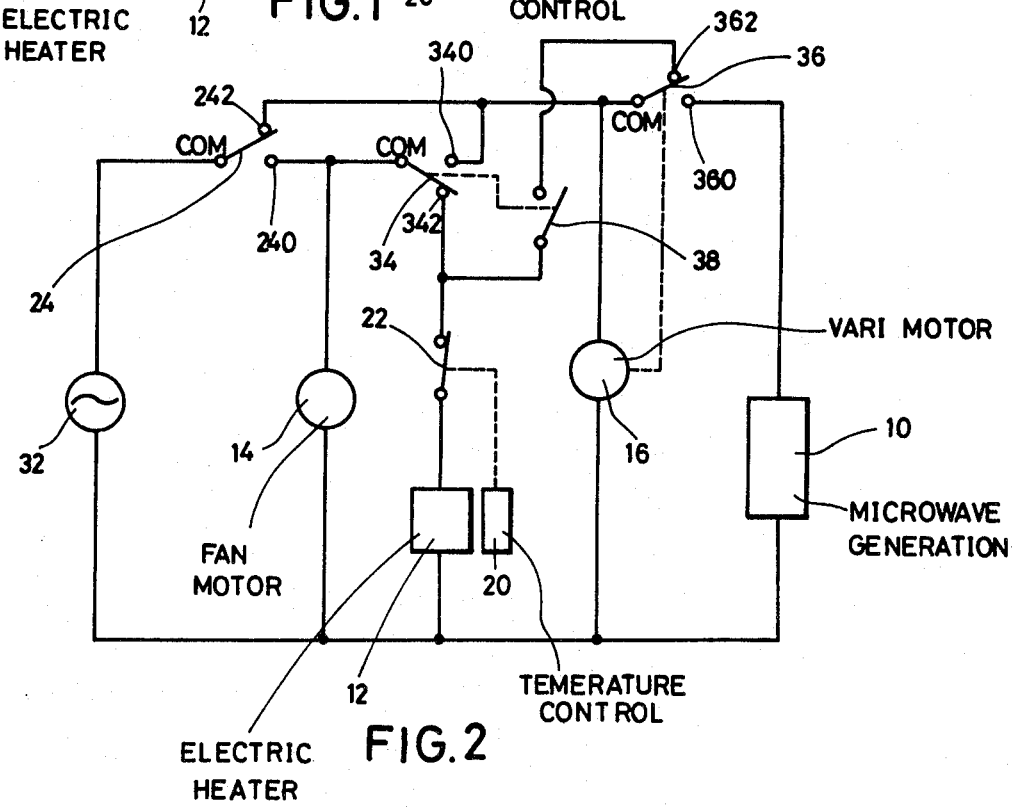
FIG. 2 is a circuit diagram of an embodiment of a combined microwave and convection cooking apparatus of the present invention.

FIG. 2 shows an embodiment of a combined microwave and convection cooking apparatus of the present invention. Like elements corresponding to those of FIG. 1 are indicated by like numerals.

A selection switch 34 is provided of which the common terminal is connected to the first contact 240 of the microwave selection switch 24, a first contact 340 is connected to the second contact 242 of the selection switch 24, and a second contact 342 is connected to the electric heater 12 via the switch 22. A selection switch 36, which corresponds to the switch 18 in FIG. 1, is provided. The common terminal of the selection switch 36 is connected to the second contact 242 of the microwave selection switch 24 and the first contact 340 of the convection selection switch 34. A first contact 360 of the selection switch 36 is connected to the microwave generation circuit 10. A heat control selection switch 38 is disposed between a second contact 362 of the selection switch 36 and the node provided between the switch 22 and the second contact 342 of the selection switch 34. The switching operation of the selection switch 36 is controlled by the rotation of the variable cooking motor 16. The heat control selection switch 38 is associated with the convection selection switch 34 so that the switch 38 is closed when the common terminal of the convection selection switch 34 is connected to the first contact 340, and the heat control switch 38 is opened when the common terminal of the convection selection switch 34 is connected to the second contact 342.

To conduct the microwave cooking operation, the common terminal of the microwave selection switch 24 is connected to the second contact 242, and the common terminal of the convection selection switch 34 is connected to the second contact 343. In response to the switching operation of the convection selection switch 34, the switch 38 is turned off. Therefore, the electric heater 12 and the fan motor 14 are never supplied with power without regard to the switching condition of the selection switch 36. The variable cooking motor 16 is supplied with power from the power source 32 via the second contact 242 of the microwave selection switch 24. In response to the rotation of the variable cooking motor 16, the selection switch 36 is repeatedly switched between the first contact 360 and the second contact 362. When the common terminal of the selection switch 36 is connected to the first contact 360, the microwave generation circuit 10 is energized to develop the microwave energy which is forwarded into the oven cavity. The cooking intensity can be controlled by properly selecting the period at which the common terminal of the selection switch 36 is connected to the first contact 360.

To conduct the convection cooking operation, the common terminal of the microwave selection switch 24 is connected to the first contact 240, and the common terminal of the convection selection switch 34 is connected to the second contact 342. In response to the switching operation of the convection selection switch 34, the heat control switch 38 is turned off. Therefore, the variable cooking motor 16 and the microwave generation circuit 10 are never supplied with power. The fan motor 14 is supplied with power via the first contact 240 of the microwave selection switch 24. The electric heater 12 is supplied with power via the second contact 342 of the convection selection switch 34 and the switch 22 which is controlled by the temperature ccontrol unit 20.

To conduct the mixed cooking operation, the common terminal of the microwave selection switch 24 is connected to the first contact 240, and the common terminal of the convection selection switch 34 is connected to the first contact 340. In response to the switching operation of the convection selection heat control switch 34, the switch 38 is turned on. The variable cooking motor 16 is supplied with power via the first contact 340 of the convection selection switch 34. The fan motor 14 is supplied with power via the first contact 240 of the microwave selection switch 24. In response to the rotation of the variable cooking motor 16, the selection switch 36 is switched between the first contact 360 and the second contact 362. When the common terminal of the selection switch 36 is connected to the first contact 360, the microwave generation circuit 10 is enabled to perform the microwave cooking. When the common terminal of the selection switch 36 is connected to the second contact 362, the electric heater 12 is energized via the switches 38 and 22. As already discussed above, the switch 22 is controlled by the temperature control unit 20 for maintaining the interior of the oven cavity at a desired temperature. During the mixed cooking operation mode, the fan motor 14 is continuously supplied with power for circulating the heated air.

In a preferred form, the variable cooking motor 16 and the selection switch 36 are constructed so that the common terminal of the selection switch 36 is connected to the first contact 360 for 3.2 seconds, and the common terminal of the selection switch 36 is connected to the second contact 362 for 28.8 seconds while the variable cooking motor 16 rotates one round in 32 seconds. The temperature control unit 20 functions to maintain the oven temperature around 325° F.

In another preferred form, the variable cooking motor 16 and the selection switch 36 are constructed so that the common terminal of the selection switch 36 is connected to the first contact 360 for 9.6 seconds, and to the second contact 362 for 22.4 seconds while the variable cooking motor 16 rotates one round in 32 seconds. The temperature control unit 20 functions to maintain the oven temperature around 375° F.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combined microwave and convection cooking apparatus comprising:

microwave cooking source means for conducting a microwave cooking operation;

convection heating source means for conducting a convection cooking operation;

selection switch means including a first contact and a second contact for selectively energizing said microwave cooking source means and said convection heating source means, said first contact being connected to said microwave cooking source means, and said second contact being selectively connected to said convection heating source means;

a heater control switch operatively connected between said second contact of said selection switch means and said convection heating source means; and a fan means being operatively connected to said heater control switch for circulating heated air;

wherein said heater control switch is closed when a mixed cooking operation is conducted and said fan means is continuously operated;

said heater control switch being opened when a microwave cooking operation is conducted without the convection cooking operation and said fan means being disengaged.

2. The combined microwave and convection cooking apparatus of claim 1, further comprising:

selection switch drive means for alternately switching said selection switch means between said first contact and said second contact.

3. A power supply control system in a combined microwave and convection cooking apparatus including a microwave generation circuit and an electric heater for conducting a convection cooking, said power supply control system comprising:

a first selection switch including a first contact, a second contact and a common terminal, said common terminal being connected to a power source, a second selection switch including a first contact, a second contact and a common terminal, the common terminal of said second selection switch being connected to said first contact of said first selection switch, the first contact of said second selection switch being connected to said second contact of said first selection switch, and the second contact of said second selection switch being connected to said electric heater, a third selection switch including a first contact, a second contact and a common terminal, the common terminal of said third selection switch being connected to said second contact of said first selection switch and said first contact of said second selection switch, the first contact of said third selection switch being connected to said microwave generation circuit, and the second contact of said third selection switch being connected to said electric heater, switch drive means connected to said power source via said common terminal of said third selection switch, said switch drive means functioning to switch said third selection switch between said first contact of said third selection switch and said second contact of said third selection switch; and a switch disposed between said second contact of said third selection switch and said electric heater, said switch being associated with said second selection switch so that the switch is closed when said common terminal of said second selection switch is connected to said first contact of said second selection switch, and the switch is opened when said common terminal of said second selection switch is connected to said second contact of said second selection switch.

* * * * *